United States Patent [19]

Kitatani et al.

[11] Patent Number: 4,719,165

[45] Date of Patent: Jan. 12, 1988

[54] PROCESS FOR PREPARATION OF CHARGE-REGULATORY AGENT AND LIQUID DEVELOPER FOR ELECTROSTATIC IMAGE CONTAINING SAID AGENT

[75] Inventors: Katsugi Kitatani; Hiroaki Yokoya; Nobuo Suzuki; Masataka Murata, all of Kanagawa, Japan

[73] Assignee: Fuji Photo Film Co., Ltd., Kanagawa, Japan

[21] Appl. No.: 912,142

[22] Filed: Sep. 24, 1986

Related U.S. Application Data

[63] Continuation of Ser. No. 767,452, Aug. 20, 1985.

[30] Foreign Application Priority Data

Aug. 20, 1984 [JP] Japan ..... 59-172955

[51] Int. Cl.[4] ..... G03G 9/12

[52] U.S. Cl. ..... 430/115; 430/110

[58] Field of Search ..... 430/115, 110

[56] References Cited

U.S. PATENT DOCUMENTS

| | | | |
|---|---|---|---|
| 2,689,858 | 9/1954 | Boyd | 556/55 X |
| 3,198,817 | 8/1965 | Langer | 556/55 X |
| 3,442,922 | 5/1969 | Langer | 556/55 X |
| 4,077,941 | 3/1978 | Stephen et al. | 556/55 X |
| 4,087,402 | 5/1978 | Monte et al. | 556/56 X |
| 4,600,676 | 7/1986 | Terada et al. | 430/110 X |
| 4,614,699 | 9/1986 | Kitatani et al. | 430/115 |

OTHER PUBLICATIONS

Chemical Abstracts 80, 15170f (1974).
Chemical Abstracts 70, 68846h (1969).
Chemical Abstracts 70, 63666n (1969).
Chemical Abstracts 86, 25486b (1977).

*Primary Examiner*—J. David Welsh
*Attorney, Agent, or Firm*—Sughrue, Mion, Zinn, Macpeak & Seas

[57] ABSTRACT

The present invention provides a process for preparation of a charge-regulatory agent characterized by reacting an amino acid with a titanium compound in an organic solvent to form a reaction mixture and further reacting the resultant reaction mixture with water which is equimolar or more to said titanium compound, and a liquid developer for development of an electrostatic image comprising a dispersion of resin-containing toner particles dispersion in a carrier solution having an electric resistance of $10^9\Omega\cdot$cm or more and a dielectric constant of 3.5 or less and containing said charge-regulatory agent prepared as mentioned above.

When an electrostatic latent image is developed with the present liquid developer containing the special charge-regulatory agent, an image of excellent resolving power, good half-tone reproduction and excellent gradation may be obtained without the occurence of any image flow.

14 Claims, 1 Drawing Figure

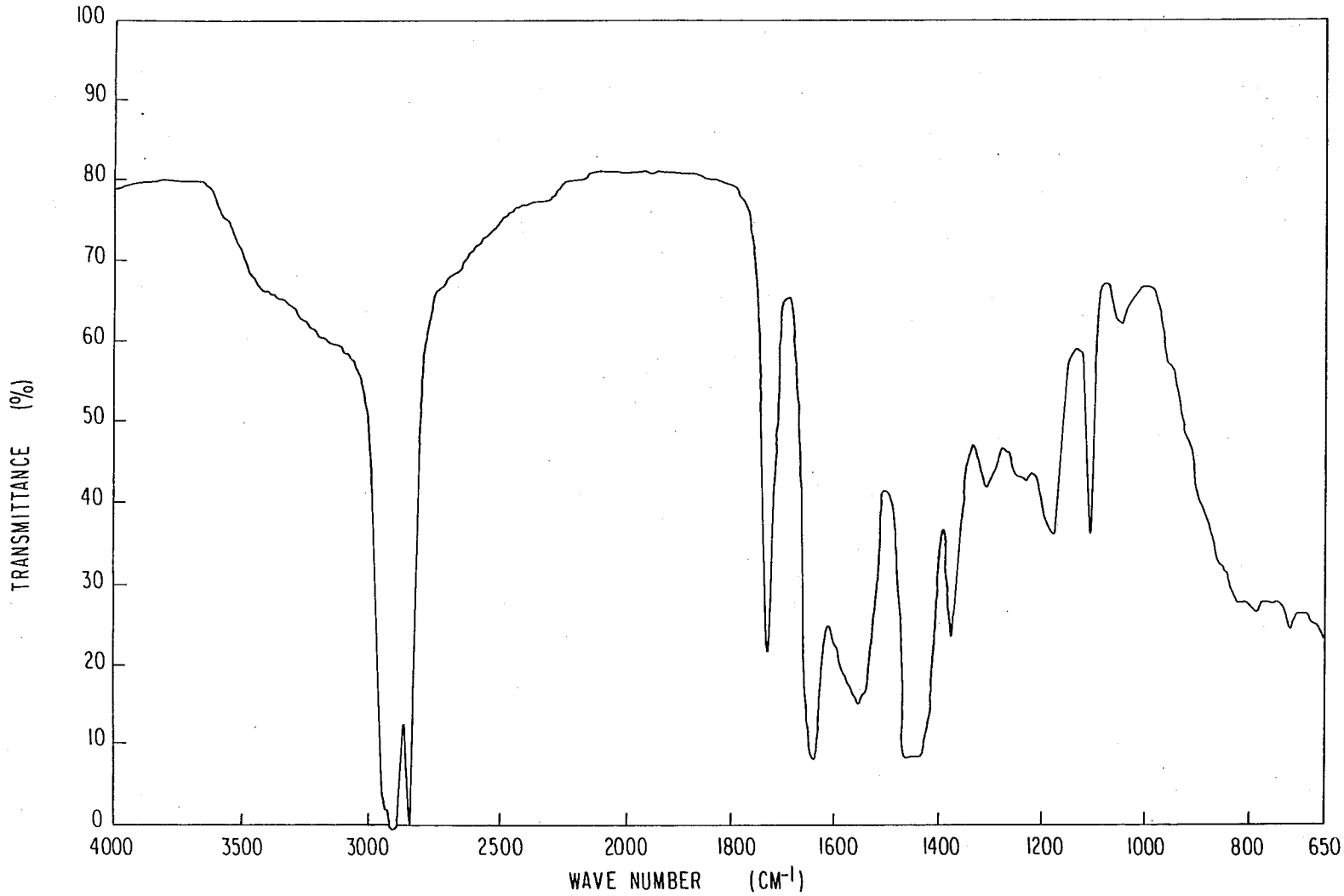
100
90
80
70
60
50
40
30
20
10
0
TRANSMITTANCE (%)
4000
3500
3000
2500
2000
1800
1600
1400
1200
1000
800
650
WAVE NUMBER (CM-1)

PROCESS FOR PREPARATION OF CHARGE-REGULATORY AGENT AND LIQUID DEVELOPER FOR ELECTROSTATIC IMAGE CONTAINING SAID AGENT

This is a continuation of application Ser. No. 767,452, filed Aug. 20, 1985.

FIELD OF THE INVENTION

The present invention relates to a process for preparation of a titanium-containing charge-regulatory agent and to a liquid developer for development of an electrostatic image containing said charge-regulatory agent. In particular, the present invention relates to a charge-regulatory agent capable of obtaining a liquid developer for development of an excellent electrostatic image of high quality which is free from the occurrence of image flow.

BACKGROUND OF THE INVENTION

A liquid developer to be used for development of an electrostatic image is prepared by dispersing, in a carrier solution having a electric resistance ($10^9$–$10^{15}$ Ω·cm), a coloring agent such as carbon black or Nigrosine, a toner particle-forming resin which may adsorb or may be coated on said agent thereby to regulate the electric charge of toner particles, to accelerate the dispersion of said particles and to improve the fixation of the formed image after development, a substance which may be dissolved in the carrier solution or may be swollen therein to increase the dispersion stability of the toner particles and a substance which may reinforce and stabilize the electric charge of the toner particles.

The electric charge of toner particles has a great influence on the formed image after development treatment, and therefore, great efforts have heretofore been made for the stabilization of said electric charge of toner particles. For example, Japanese Patent Application (OPI) No. 151154/75 (The term "OPI" as used herein refers to a "published unexamined Japanese application".) has proposed to use a reaction mixture obtained by blending and heating a fatty acid and an organic titanium compound in a liquid developer for an electronic photography as a dispersing agent and a charge control agent. On the other hand, Japanese Patent Publication No. 2952/81 has proposed to use a reaction mixture obtained by blending and heating a carboxyl-containing synthetic resin and a tetra-valent organic titanium compound, as a dispersing agent, a fixing agent and a charge control agent. In general, it is known that an organic titanium compound may rapidly react with an organic acid to form a titanium acylate, and therefore, it is easily assumed that a titanium carboxylate will be formed in said prior art techniques. Electric charge-regulatory agents which have heretofore been known are insufficient as the amount of the electric charge thereof is not sufficiently high, and therefore, when a developer containing said known charge-regulatory agent is used, an image flow is apt to occur in the formed image. Under the circumstances, the present inventors previously proposed novel charge-regulatory agents in Japanese patent Application (OPI) No. 21056/85 (corresponding to U.S. patent application Ser. No. 631,114). In addition to said prior application, the present inventors have now developed other novel charge-regulatory agents having further excellent charge-characteristics which may be prepared by means of a further simple process, and have achieved the present invention.

SUMMARY OF THE INVENTION

The subject matter of the present invention is to develop a novel charge-regulatory agent having a sufficient charge amount and an excellent time stability thereof and to provide an improved liquid developer containing said charge-regulatory agent capable of developing an excellent electrostatic image of high quality which is free from occurrence of image flow.

Accordingly, one object of the present invention is to provide a process for preparation of a charge-regulatory agent, characterized in that an amino acid is reacted with a titanium compound in an organic solvent to form a reaction mixture and the resultant reaction mixture is blended and reacted with water which is equimolar or more to said titanium compound.

Another object of the present invention is to provide a liquid developer for development of an electrostatic image, comprising a dispersion of resin-containing toner particles dispersed in a carrier solution having an electric resistance of $10^9$ Ω·cm or more and a dielectric constant of 3.5 or less, characterized in that said liquid developer contains a charge-regulatory agent prepared by reacting an amino acid with a titanium compound in an organic solvent to form a reaction mixture and further reacting the resultant reaction mixture with water which is equimolar or more to said titanium compound.

BRIEF DESCRIPTION OF THE DRAWING

The FIGURE is a graph showing the IR-absorption spectrum of the reaction mixture containing N-n-octyl-N-myristoyl-β-alanine-titanium salt in Example 1.

DETAILED DESCRIPTION OF THE INVENTION

Amino acids which may be used in the present invention are preferably those represented by the following formula (I) or (II):

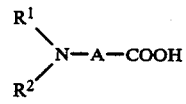

(I)

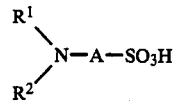

(II)

wherein $R^1$ and $R^2$ independently represent a hydrogen atom; an alkyl group having 1–22 carbon atoms, e.g., a methyl group, an ethyl group, a propyl group, an isopropyl group, an octyl group, a stearyl group, a 2-ethylhexyl group, etc.; a substituted alkyl group (substituted by one or more substituents selected from a dialkylamino group, an alkyloxy group and an alkylthio group); an aryl group having 6–24 carbon atoms, e.g., a phenyl group, a napthyl group, a tolyl group, etc.; a substituted aryl group (substituted by one or more substituents selected from a dialkylamino group, an alkyloxy group, an alkylthio group, a chlorine atom, a bromine atom, a cyano group, a nitro group and a hydroxyl group); an aralkyl group; an acyl group having 1–22 carbon atoms, e.g., an acetyl, a propionyl group, an octanoyl group, a myristoyl group, a stearoyl group, etc.; an alkylsulfonyl group, e.g., a methanesulfonyl group, an ethanesulfonyl group, a propanesulfonyl group, a butanesulfonyl group, etc.; or an arylsulfonyl group having 6–24 carbon atoms, e.g., a benzenesulfonyl group, a toluenesulfonyl group, a naphthalenesulfonyl group, etc.; these $R^1$ and $R^2$ may be same or different from each other; and $R^1$–$R^2$ may form a ring; with the proviso that both $R^1$ and $R^2$ must not be a hydrogen atom at the same time; and A is an alkylene group having 1–10 carbon atoms, e.g., a methylene group, an ethylene group, a propylene group, etc., or a substituted alkylene group.

In particular, amino acids of the formula (I) are especially preferred, in view of the reactivity thereof with a titanium compound. In the formula (I), the total carbon atoms of $R^1$ and $R^2$ are preferably 8 to 36, and it is preferred that either of $R^1$ or $R^2$ is an acyl group.

An inorganic titanium compound or an organic titanium compound may be used in the present invention, to be reacted with the amino acid as mentioned above, and in particular, organic titanium compounds are more preferred in the present invention.

Typical examples of inorganic titanium compounds which may be used in the present invention include titanium tetrachloride, titanium bromide ($TiBr_4$), titanium iodide ($TiI_4$), etc.

Organic titanium compounds which may be used in the present invention include those represented by the following general formula (III):

$$B^3{}_nTiX_{(4-n)} \quad \text{(III)}$$

wherein $R^3$ represents an alkyl group (preferably $C_1$ to $C_{10}$), an aralkyl group (preferably $C_7$ to $C_{12}$) or an aryl group (preferably $C_6$ to $C_{12}$); X is a halogen atom, an alkoxy group or an acyloxy group; and n is an integer of 0 to 3; with the proviso that when n is 0, at least one X must be an alkoxy group; in one molecule thereof, a plural different X and $R^3$ may be contained.

Examples of said organic titanium compounds are titanium-tetraisopropoxide, titanium-tetrabutoxide, titanium-tetrastearoxide, diisopropoxytitanium-dichloride, triisopropoxy-titanium-monochloride, diethyl-titanium-diisopropoxide, diethyl-titanium-dichloride; dioleyl-titanium-diisopropoxide, etc.

Among said compounds, alkoxides are especially preferred, as being easily handled, and in particular, titanium-tetraisopropoxide is most preferred.

An organic solvent is used in the preparation of the charge-regulatory agents of the present invention, and those which may dissolve the above described titanium compounds and amino acids but do not react therewith are preferred therefor. In addition, it is necessary that said organic solvent does not adversely affect a liquid developer when added thereto. For example, alcohols such as ethanol and isopropanol; hydrocarbons such as hexane, cyclohexane, benzene and toluene; isoparaffin-type petroleum solvents such as Isopar G and Isopar H (be Esso Co.) which are generally used as a carrier solution for a liquid developer; and halogeno-hydrocarbons such as carbon tetrachloride and chloroform are preferred as the organic solvent of the present invention. These solvents may be used in the form of a mixture thereof, or may be substituted by any other solvent after the reaction of said amino acid and titanium compound.

According to the process of the present invention, said amino acid and said titanium compound are reacted in said organic solvent, and then the resultant reaction mixture is blended and reacted with water, to obtain the desired charge-regulatory agent.

The molar ratio of the amino acid and the titanium compound to be reacted is preferably within the range of 1:4–4:1, and more preferably within the range of 1:2–2:1. The reaction may be carried out under various conditions, and in general, is preferably carried out at a temperature falling within the range of 20° to 80° C. If necessary, a base may be added to the reaction system to accelerate the reaction.

The resultant reaction mixture is further blended and reacted with water, and one method for said reaction with water is to use a reaction solvent capable of dissolving water. In this first case, a necessary amount of water may simply be added to the reaction system. Another method therefor is to use a mixture solvent system comprising a non-polar solvent and a solvent capable of dissolving water. In this second case, it is desired that the amount of water to be added and the amount of the used solvent capable of dissolving the added water are appropriately regulated so that the reaction system may be a uniform system. For example, a mixture solvent system comprising 50 ml of isopropanol and 50 ml of n-hexane may be kept as a uniform system for 1 ml of water has been added thereto. In the process of the present invention, water is added and reacted with the reaction mixture of amino acid and titanium compound, whereby said reaction mixture is hydrolyzed. In the above mentioned two methods, it is necessary to take care so that they hydrolysis does not proceed too much. The regulation of the degree of the hydrolysis may be carried out by properly controlling the amount of water to be added. In general, it is appropriate to regulate the amount of water to be added to the reaction system to be 1 mole or more on the basis of one mole of the used organic titanium compound, and preferably to fall within 1 to 10 moles to one of said titanium compound. If the amount of the added water is less than one mole, any sufficient hydrolysis does not occur, and thus the charge amount of the formed charge-regulatory agent is insufficient when incorporated in a liquid developer, resulting in occurrence of image flow in the formed image. On the contrary, if the amount of the added water is more than 10 moles, the hydrolysis is apt to proceed too much, which often causes precipitates which are insoluble in a non-polar carrier solution to be used in a liquid developer. As in the case may be, even if such precipitates do not occur, the time stability of the formed reaction mixture solution is often bad when the hydrolysis proceeds too much.

Still another method for the hydrolysis of said reaction mixture is to disperse water in the reaction system in such a state that the reaction system may become non-uniform after the hydrolysis reaction, and thereafter to heat and stir the reaction system. This third method applies to the case where the reaction of amino acid and titanium compound is carried out in a non-polar solvent only. In this case, the used non-polar solvent may hardly solubilize water in the reaction system, and therefore, an extremely excess amount of water must be added to the reaction system. For example, about 300 moles of water are added, on the basis on one mole of the used organic titanium compound, without occurrence of any excess hydrolysis. In any case, it is possible to remove water from the reaction system after the hydrolysis treatment. For example, various methods may be used for the removal of water, including a method for distillation where a solvent capable of being azeotropic with water is added to the reaction system to distill out the excess water; a method for filtration where the reaction system is diluted with a large amount of a non-polar solvent and the separated water is filtrated out; and a method for addition of a dessicant such as anhydrous sodium sulfate to the reaction system.

As the carrier solution to be used in the preparation of the liquid developer of the present invention, a solvent having an electric resistance of $10^9$ Ω·cm or more and a dielectric constant of 3.5 or less is used because the electrostatic image must not be damaged during development operation. For example, aliphatic hydrocarbons, alicyclic hydrocarbons, aromatic hydrocarbons, halogeno-hydrocarbons and polysiloxanes may be used as said carrier solution, and in general, isoparaffin-type petroleum solvents are preferred in view of the volatility, safety, toxicity, odor, etc. Examples of said isoparaffin-type petroleum solvents are Isopar G,, Isopar H, Isopar L and Isopar K (by Esso Co.) and Shell Sol 71 (by Shell Petroleum Co.).

The developer of the present invention may contain a resin which is insoluble in a carrier solution or may swell in said carrier solution, as a toner particle-forming resin. Such resin has an activity to adsorb on particles of a coloring agent contained in the developer or to form a coat-film around said particles thereby to accelerate the dispersibility of the particles of said coloring agent in the developer or an activity to act as a binder of said coloring agent after development treatment thereby to improve the fixation stability of the developer. Various kinds of conventional resins may be used as said toner particle-forming resin, including, for example, rubbers such as butadiene rubbers, styrene-butadiene rubbers, cyclic rubbers, natural rubbers, etc.; synthetic resins such as styrene resins, vinyl-toluene resins, acrylic resins, methacrylic resins, polyester resins, polycarbonate resins, polyvinyl acetate resins, etc.; natural resins such as rosin resins, hydrogenated rosin resins, modified alkyd (such as linseed oil-modified alkyd)-containing alkyd resins, polyterpenes, etc. In addition, other resins such as modified phenol resin-containing phenol resins such as phenol-formalin resins, and natural resin-modified maleic acid resins, pentaerythritol phthalates, chromanindene resins, ester gum-resins, vegetable oil-polyamides; as well as halogenated hydrocarbon polymers such as polyvinyl chloride and chlorinated polypropylene may also be used as said toner particle-forming resin.

In order to elevate the dispersibility of the developer of the present invention, a conventional dispersing agent may be incorporated therein. Said dispersing agent is a resin capable of dissolving or swelling in the non-aqueous solvent having a high electric resistance to be used in the developer of the present invention as a carrier solvent, thereby to elevate the dispersibility of toner particles contained in the developer. Various kinds of resins may be used therefor, for example, including synthetic rubbers such as styrene-butadiene rubber, vinyl-toluene-butadiene, butadiene-isoprene; polymers of long-chain alkyl-containing acrylic monomers such as 2-ethylhexyl methacrylate, lauryl methacrylate, stearyl methacrylate, lauryl acrylate or octyl acrylate, or copolymers of said monomer and other polymerizable monomers, such as styrene-lauryl methacrylate copolymer, acrylic acid-lauryl methacrylate copolymer, etc.; polyolefins such as polyethylene; and polyterpenes, etc. In addition, polymers containing quaternary ammonium salt monomers as described in Japanese Patent Application (OPI) No. 31739/79 may also be used as the dispersing agent.

A conventional charge-regulatory agent may be co-used in the developer of the present invention, if desired, which is, however, not indispensable but optional. Pertinent examples of said conventional charge-regulatory agents are metal salts of fatty acids such as naphthenic acid, octenoic acid, oleic acid, stearic acid, isostearic acid or lauric acid; metal salts of sulfosuccinates; oil-soluble metal sulfonates as described in Japanese Patent Publication No. 556/70 (corresponding to British Patent No. 1,172,720) and Japanese Patent Application (OPI) Nos. 37435/77 and 37049/77 (each corresponding to U.S. Pat. No. 4,138,351); metal salts of phosphates as described in Japanese Patent Publication No. 9594/70 (corresponding to U.S. Pat. No. 3,793,015); metal salts of abietic acid or hydrogenated abietic acid as described in Japanese Patent Publication No. 25666/73; Ca-salts of alkylbenzene-sulfonic acids as described in Japanese Patent Publication No. 2620/80; metal salts of aromatic carboxylic acids or sulfonic acids as described in Japanese Patent Application (OPI) Nos. 107837/77, 38937/77, 90643/82 and 139753/82; non-ionic surfactants such as polyoxyethylated alkylamines; fats and oils such as lecithin, linseed oil, etc.; polyvinylpyrrolidone; organic acid esters of polyvalent alcohols; oil-soluble phenol resins as described in Japanese Patent Publication No. 3716/71; phosphate-type surfactants as described in Japanese Patent Application (OPI) No. 210345/82; and sulfonic acid resins as described in Japanese Patent Publication No. 24944/81, etc.

A coloring agent may be used in the developer of the present invention, comprising conventional pigement and/or dyestuff which are generally used in conventional liquid developers. For example, Hansa Yellow (C.I. 11680), Benzidine Yellow G (C.I. 21090), Benzidine Orange (C.I. 21110), Fast Red (C.I. 37085), Brilliant Carmine 3B (C.I. 16015-Lake), Phthalocyanine Blue (C.I. 74160), Phthalocyanine Green (C.I. 74260), Victoria Blue (C.I. 42595-Lake), Spirit Black (C.I. 50415), Oil blue (C.I. 74350), Alkali Blue (C.I. 42770A), Fast Scarlet (C.I. 12315), Rhodamine 6B (C.I. 45160), Fast Sky Blue (C.I. 74200-Lake), Nigrosine (C.I. 50415), carbon black, etc. may be used. Surface-treated pigments such as Nigrosine-colored carbon blacks or polymer-grafted carbons (graft-carbon) may also be used. In addition, bisaryl-azoderivatives of 2,3-naphthalenediol as described in Japanese patent publication No. 195157/82; formazan dye-pigments as described in Japanese Patent Publication No. 4440/72 (corresponding to British Pat. No. 1,257,957); lake pigments as described in Japanese Patent Publication Nos. 1431/76 (corresponding to British Pat. No. 1,343,709), 4912/81 and 4911/81, etc. may also be used as the coloring agent of the present invention.

The developer of the present invention may be prepared by a conventional known method. Some embodiments of the preparation of the present developers are described below.

In the first place, a coloring agent comprising a pigment and/or a dye and the above described toner particle-forming resin are kneaded in a solvent which is compatible with said resin by the use of a ball mill, roll mill or paint shaker or the like milling device, and thereafter heated to remove the solvent to obtain a kneaded mixture.

Alternatively, the above mixture is poured into a liquid which does not dissolve said resin to obtain a kneaded mixture by re-sedimentation.

As another alternative, said coloring agent and resin are kneaded, while being heated at a higher temperature than the melting point of said resin, in a milling machine such as a kneader or a three-roll mill, and thereafter cooled to obtain a kneaded mixture.

The kneaded mixture thus obtained is, after optionally being dye-pulverized, subjected to wet-pulverization together with a dispersing agent, to obtain a concentrated toner solution. The solvent to be used in said wet-pulverization may be a carrier solution itself or may be a mixture of said carrier solution and 1–20 wt% of a solvent which is compatible with the used resin, such as toluene or acetone.

The concentrated toner solution thus obtained is then dispersed in a non-aqueous solvent solution containing the charge-regulatory agent of the present invention, at last to obtain a liquid developer for development of an electrostatic image. The concentration of the toner particles in the developer is not specifically limitative, and is, in general, 0.01–100 g, preferably 0.1–10 g, per one liter of the used carrier solution. Any other methods than the above described ones may of course be utilized for the addition of the present charge-regulatory agent in the carrier solution to obtain the liquid developer. For instance, the charge-regulatory agent may be added during the kneading operation or during the wet-pulverization operation, or said agent may be added both during the kneading operation and the wet-pulverization operation. The concentration of the present charge-regulatory agent in the liquid developer is preferably controlled so that the developer, which in a final state to be ready for actual use, may contain $1\times10^{-5}$ to $1\times10^{-2}$ mole of titanium, more preferably contains $5\times10^{-5}$ to $5\times10^{-4}$ mole of titanium, per one liter of the developer.

The developer of the present invention may be used for conventional photosensitive materials having conventional organic photo-conductive substances or inorganic photo-conductive substances. In addition, the present developer may also be used for development of an electrostatic latent image formed by some other means than light-exposure such as by a charging process of dielectrics by the use of a charging needle.

Various kinds of organic photo-conductive substances of an extremely broad range have heretofore been known in this technical field, including, for example, substances described in "Research Disclosure", No. 10938, page 61 sq., (May, 1973), entitled "Electrophotographic elements, materials and processes".

Examples of practical substances to which the liquid developer of the present invention may be applied are electro-photographic materials comprising poly-N-vinyl-carbazole and 2,4,7-trinitrofluoren-9-one (U.S. Pat. No. 3,484,239); poly-N-vinylcarbazole sensitized with a pyrylium salt-type dye (Japanese Patent Publication No. 25658/73, corresponding to U.S. Pat. No. 3,617,268); electro-photographic materials comprising an essential component of an organic pigment (Japanese Patent Application (OPI) No. 37543/72, corresponding to U.S. Pat. No. 3,898,084); electro-photographic materials comprising an essential component of a co-crystalline complex composed of a dye and a resin (Japanese Patent Application (OPI) No. 10785/72, corresponding to U.S. Pat. Nos. 3,732,180 and 3,684,502).

Regarding the other inorganic photo-conductive substances which may be used in the present invention, various kinds of inorganic compounds are typical, as described in "Electrophotography" (by R. M. Schaffert, Focal Press (London), 1975, pp. 260–374). Examples of said substances include zinc oxide, zinc sulfide, cadmium sulfide, selenium, selenium-tellurium alloy, selenium-arsenic alloy, selenium-tellurium-arsenic alloy, etc.

The present invention will be explained in greater detail by reference to the following examples, which, however, are not intended to be interpreted as limiting the scope of the present invention.

Unless otherwise specified, all ratios, percents, etc. are by weight.

EXAMPLE 1

N-n-octyl-N-myristoyl-β-alanine (4.11 g, 0.01 mole) was dispersed in Isopar G (90 ml), and titanium-tetraisopropoxide (2.84 g, 0.01 mole) was added thereto. The whole was heated and stirred for 1 hour at 80° C., and then 50 ml of water was added thereto and further heated and stirred for 1 hour at 80° C. After being cooled, the organic layer was separated from the reaction mixture, and then diluted with Isopar G to make 100 ml in total. 10 ml of the resultant solution was taken out and then concentrated under reduced pressure, to obtain a liquid substance weighing 472 mg. The FIGURE shows an IR-absorption spectrum of the thus obtained substance (=reaction mixture containing N-n-octyl-N-myristoyl-β-alanine-titanium salt) as measured with a Hitachi IR-Spectrophotometer 260–10 (by Hitachi Co.), where a broad absorption (1500 $cm^{-1}$ to 1600 $cm^{-1}$) of the carboxylate on the basis of the titanium salt of the amino acid was observed. The titanium content in the resultant product was 9.59 to 9.95%, as determined by elemental analysis, which shows that the content of the titanium is about one mole to one mole of the used amino acid. On these grounds, it is assumed that the above obtained solution comprises N-n-octyl-N-myristoyl-β-alanine/titanium salt having a titanium concentration of 0.095–0.098M.

EXAMPLE 2

N-n-octyl-N-myristoyl-β-alanine (4.11 g, 0.01 mole) was dispersed in 50 ml of isopropyl alcohol, and titanium-tetraisopropoxide (2.84 g, 0.01 mole) was added thereto. The whole was reacted for 1 hour at 80° C., and then 40 ml of Isopar G and 1 ml of water were added thereto and kept at room temperature for one night and reacted. Afterwards, the whole was diluted with Isopar G to make 100 ml in total, to obtain a solution containing N-n-octyl-N-myristoyl-β-alanine/titanium salt.

EXAMPLE 3

N-n-octyl-N-myristoyl-β-alanine (4.11 g, 0.01 mole) was dispersed in 50 ml of Isopar G, and a solution of Isopar G containing titanium tetrachloride (1.90 g, 0.01 mole, Isopar G 40 ml) was added thereto. While the whole was stirred at room temperature, triethylamine (4.04 g, 0.04 mole) was added dropwise thereto, and, after the addition thereof, the whole was further heated and stirred for 1 hour at 80° C. Afterwards, the reaction system was cooled and 100 ml of water was added thereto and the whole was again heated and stirred for 1 hour at 80° C. and reacted, and then cooled. Thus, the separated organic layer was isolated and rinsed with water. This was diluted with Isopar G to make 100 ml in total, to obtain a solution comprising N-n-octyl-N-myristoyl-β-alanine/titanium salt.

EXAMPLE 4

In the same manner as in the Example 2, with the exception that 0.01 mole of each of the following compounds was used instead of N-n-octyl-N-myristoyl-β-alanine used in the Example 2, three kinds of titanium salt-solutions were obtained.

Compound No. 1.

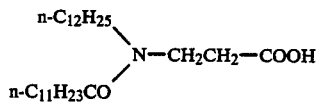

Compound No. 2.

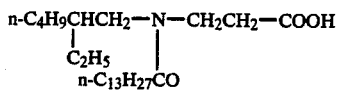

Compound No. 3

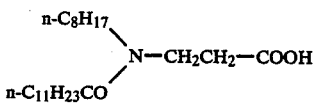

COMPARATIVE EXAMPLE 1

N-n-octyl-N-myristoyl-β-alanine (4.11 g, 0.01 mole) was dispersed in 90 ml of Isopar G, and titanium-tetraisopropoxide (2.84 g, 0.01 mole) was added thereto. The whole was heated and stirred for 1 hour at 80° C. and then cooled, and thereafter diluted with Isopar G to make 100 ml in total.

EXAMPLE 5

| | |
|---|---|
| Carbon black (#40, by Mitsubishi Chemical Industries Co.) | 0.8 wt. part |
| Monochloro-copper phthalocyanine (Cyanine blue SR-5020, by Dainichiseika Colour & Chemical Mfg. Co., Ltd.) | 0.2 wt. part |
| n-Stearyl methacrylate/methyl methacrylate copolymer (molar ratio = 1:9) | 2 wt. parts |

The above mixture was kneaded in a three-roll-mill heated at 140° C., and then, after being cooled, the kneaded mixture was roughly pulverized to obtain a resin-containing pigment powder. To one wt. part of thus obtained resin-pigment powder was added 0.3 wt. part of Solprene 1205 (by Asahi Chemical Industry Co., Ltd., styrene-butadiene copolymer), and then blended with 23 wt. parts of Isopar G and the whole was milled in a ball mill for three full days, to obtain a dispersion of a concentrated toner solution. On the other hand, each of the solutions obtained in the previous Examples 1 through 4 and Comparative Example 1 was diluted with Isopar G to form a charge-regulatory agent-containing solution having a titanium concentration of $1\times10^{-4}$M. Using this, the above prepared toner solution was diluted, to obtain seven kinds of negative-charged liquid developers. In each of these liquid developers, the solid concentration was controlled to be 1 g/liter. The charged amount of each of the above obtained liquid developers was determined by the use of an apparatus and a method as described in Japanese Patent Application (OPI) No. 58176/82, and the results are given in the following Table 1.

TABLE 1

| Developer No. | Charge-regulatory agent | Charged amount (mV/sec) |
|---|---|---|
| 1 | Solution of Example 1 | 34.8 |
| 2 | Solution of Example 2 | 31.0 |
| 3 | Solution of Example 3 | 30.0 |
| 4 | Solution of Example 4, Compound No. 1 | 39.7 |
| 5 | Solution of Example 4, Compound No. 2 | 61.4 |
| 6 | Solution of Example 4, Compound No. 3 | 43.0 |
| 7 | Solution of Comparative Example 1 | 17.3 |

Next, a solution comprising 100 wt. parts of poly-N-vinylcarbazole (PVCz), 5 wt. parts of vinylidene chloride/acrylonitrile copolymer, 3 wt. parts of styrene/butadiene copolymer and 0.35 g of 2,6-di-t-butyl-4-[4-(N,N-dichloroethylamino)styryl]thiapyryliumtetrafluoroborate as dissolved in 2000 ml of 1,2-dichloroethane was coated on a polyethylene terephthalate (PET) film (thickness: 100 μm) having an $In_2O_3$-plated layer (thickness, 60 nm, plated by vacuum evaporation plating) (i.e. $In_2O_3$-electro-conductive PET-film), and then dried to remove the used solvents, thereby to form a photo-conductive layer having a thickness of 5 μm on said film support to prepare an electro-photographic film.

The surface of the thus prepared film was charged with +350V, and exposed imagewise through a positive original, to form an electrostatic latent image thereon.

The thus processed electro-photographic film having an electrostatic latent image thereon was developed with each of the previously prepared seven kinds of liquid developers, and the formed image was observed.

The above Table 1 proves that the charged amount of each of the developers Nos. 1 through 6 containing the charge-regulatory agent of the present invention is sufficiently high; whereas, the charged amount of the developer No. 7 containing a different charge-regulatory agent, which was prepared with no use of water in the Comparative Example 1 is low and insufficient. In addition, it was noted that the charged amount of each of the developers Nos. 1 through 6 almost did not change at all with the lapse of time, after being preserved for long time, whereas, that of No. 7 was lowered.

Under the circumstances, every image obtained by development with each of the developers Nos. 1 through 6 was observed to be extremely good in its resolving power, half-tone reproduction and gradation; whereas, the image obtained by development with the developer No. 7 was observed to have image flow.

From the above results, the effect of the present invention is apparent.

While the invention has been described in detail and with reference to specific embodiments thereof, it will be apparent to one skilled in the art that various changes and modifications can be made therein without departing from the spirit and scope thereof.

What is claimed is:

1. A liquid developer for development of an electrostatic image, comprising a dispersion of resin-containing toner particles dispersed in a carrier solution having an electric resistance of $10^9$ Ω·cm or more and a dielectric constant of 3.5 or less, characterized in that said liquid developer contains a charge-regulatory agent prepared by reacting an amino acid with a titanium compound in an organic solvent to form a reaction mixture and further reacting the resultant mixture with water which is equimolar or more to said titanium compound, wherein the amino acid used in the preparation of the charge-regulatory agent is an amino acid represented by the following formula (I) or (II)

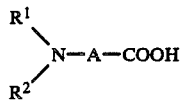

(I)

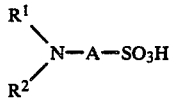

(II)

wherein $R^1$ and $R^2$ independently represent a hydrogen atom; an alkyl group having 1–22 carbon atoms; an alkyl group substituted by one or more substituents selected from a dialkylamino group, an alkyloxy group and an alkylthio group; an aryl group having 6–24 carbon atoms; an aryl group substituted by one or more substituents selected from a dialkylamino group, an alkyloxy group, an alkylthio group, a chlorine atom, a bromine atom, a cyano group, a nitro group and a hydroxyl group; an aralkyl group; and acyl group having 1–22 carbon atoms; an alkylsulfonyl group or an arylsulfonyl group having 6–24 carbon atoms; these $R^1$ and $R^2$ may be same or different from each other, and $R^1$–$R^2$ may form a ring, with the proviso that both $R^1$ and $R^2$ must not be a hydrogen atom at the same time; and A is an alkylene group having 1–10 carbon atoms or a substituted alkylene group.

2. A liquid developer for development of an electostatic image, comprising a dispersion of resin-containing toner particles dispersed in a carrier solution having an electric resistance of $10^9$ Ω·cm or more and a dielectric constant of 3.5 or less, characterized in that said liquid developer contains a charge-regulatory agent prepared by reacting an amino acid with a titanium compound in an organic solvent to form a reaction mixture and further reacting the resultant mixture with water which is equimolar or more to said titanium compound, wherein the amino acid used in the preparation of the chage-regulatory agent is an amino acid represented by the following formula (I)

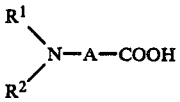

(I)

wherein $R^1$ and $R^2$ independently represent a hydrogen atom; an alkyl group having 1–22 carbon atoms; an alkyl group substituted by one or more substituents selected from a dialkylamino group, an alkyloxy group and an alkylthio group; an aryl group having 6–24 carbon atoms; an aryl group substituted by one or more substituents selected from a dialkylamino group, an alkyloxy group an alkylthio group, a chlorine atom, a bromine atom, a cyano group, a nitro group and a hydroxyl group; an aralkyl group; an acyl group having 1–22 carbon atoms; an alkylsulfonyl group or an arylsulfonyl group having 6–24 carbon atoms; these $R^1$ and $R^2$ may be same or different from each other, and $R^1$–$R^2$ may form a ring, with the proviso that both $R^1$ and $R^2$ must not be a hydrogen atom at the same time; and A is an alkylene group having 1–10 carbon atoms or a substituted alkylene group.

3. The liquid developer for development of an electrostatic image as claimed in claim 2, wherein the total carbon atoms of $R^1$ and $R^2$ in the formula (I) are 8 to 36.

4. The liquid developer for development of an electrostatic image as claimed in claim 2, wherein either of $R^1$ or $R^2$ in the formula (I) is an acyl group.

5. The liquid developer for development of an electrostatic image as claimed in claim 2, wherein the titanium compound used in the preparation of the charge-regulatory agent is an inorganic titanium compound or an organic titanium compound.

6. The liquid developer for development of an electrostatic image as claimed in claim 5, wherein the inorganic titanium compound used in the preparation of the charge-regulatory agent is an inorganic titanium compound selected from titanium tetrachloride, titanium bromide and titanium iodide.

7. The liquid developer for development of an electrostatic image as claimed in claim 5, wherein the titanium compound used in the preparation of the charge-regulatory agent is an organic titanium compound of the following formula (III):

$$R^3{}_nTiX_{(4-n)} \qquad \text{(III)}$$

where $R^3$ represents an alkyl group, an aralkyl group or an aryl group; X is a halogen atom, an alkoxy group or an acyloxy group; n is n integer of 0 to 3; with the proviso that when n is 0, at least one of X must be an alkoxy group.

8. The liquid developer for development of an electrostatic image as claimed in claim 7, wherein the titanium compound used in the preparation of the charge-regulatory agent is titanium-tetraisopropoxide, titanium-tetrabutoxide, titanium-tetrastearoxide, diisopropoxy-titanium-dichloride, triisopropoxy-titanium-monochloride, diethyl-titanium-diisopropoxide, diethyltitanium-dichloride or dioleyl-titanium-diisopropoxide.

9. The liquid developer for development of an electrostatic image as claimed in claim 2, wherein said amino acid and titanium compound are reacted in an organic solvent selected from an alcohol, a hydrocarbon, an isoparaffin-type petroleum solvent, a halogenohydrocarbon or a mixture of said solvents.

10. The liquid developer for development of an electrostatic image as claimed in claim 2, wherein the molar ratio of said amino acid to said titanium compound is within the range of 1:4–4:1.

11. The liquid developer for development of an electrostatic image as claimed in claim 2, wherein said toner particles are used in a concentration of 0.01 to 100 g per one liter of the carrier solution.

12. The liquid developer for development of an electrostatic image as claimed in claim 2, wherein said charge-regulatory agent is used in a concentration such that the developer contains $1\times10^{-5}$ to $1\times10^{-2}$ mol of titanium per one liter of the developer.

13. The liquid developer for developer of an electrostatice image as claimed in claim 2, wherein said charge-regulatory agent is used in a concentration such that the developer contains $5\times10^{-5}$ to $5\times10^{-4}$ mol of titanium per one liter of the developer.

14. A process for forming an image in an electrostatic element, comprising imagewise exposing and developing an electrostatic element using the liquid developer claimed in claim 2.

* * * * *